United States Patent [19]

Anderson, Jr.

[11] 4,407,212

[45] Oct. 4, 1983

[54] TACK HOOK ASSEMBLY FOR SAIL BOATS

[76] Inventor: Robert C. Anderson, Jr., 26 Lark St., Gloversville, N.Y. 12078

[21] Appl. No.: 314,683

[22] Filed: Oct. 26, 1981

[51] Int. Cl.[3] ..... B63H 9/04

[52] U.S. Cl. ..... 114/108; 114/102; 114/114

[58] Field of Search ..... 114/102, 108, 111, 113, 114/114, 115, 204, 218; 24/230 SW, 230 R, 241 R, 236, 237; 267/182

[56] References Cited

U.S. PATENT DOCUMENTS 3,341,907 9/1967 Michael ..... 114/108

3,851,609 12/1974 Stearn ..... 114/108

3,859,693 1/1975 Breed ..... 114/108

4,245,377 1/1981 Soltes ..... 24/230 R

*Primary Examiner*—Trygve M. Blix

*Assistant Examiner*—Rodney Corl

*Attorney, Agent, or Firm*—Gerhard K. Adam

[57] ABSTRACT

A tack hook assembly comprises at least one lateral member and an associated resilient member which enables one to forceably attach and detach a fastener device by use of only one hand. The assembly is particularly suitable for sailboat racing to permit ease and speed in headsail changes.

11 Claims, 6 Drawing Figures

FIG. 3
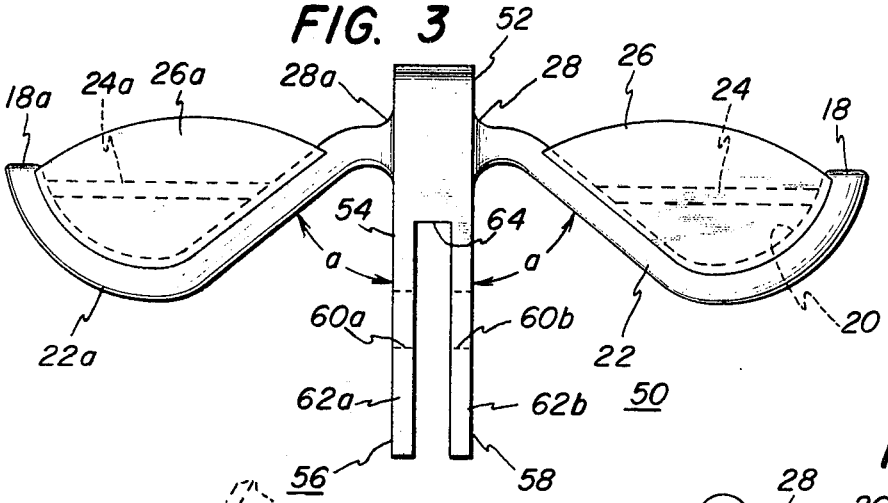
FIG. 2
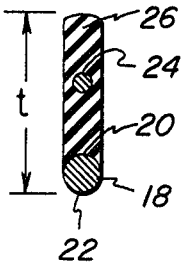
FIG. 1
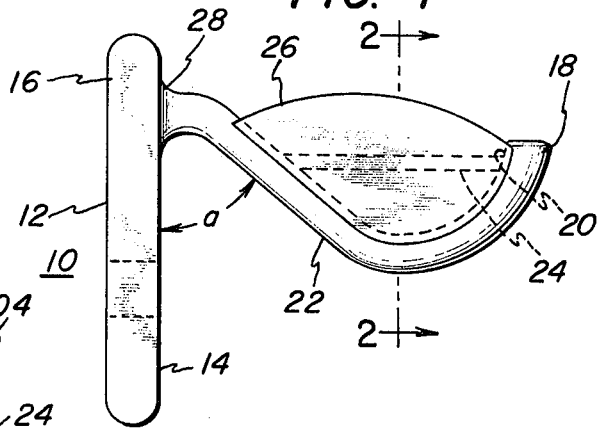
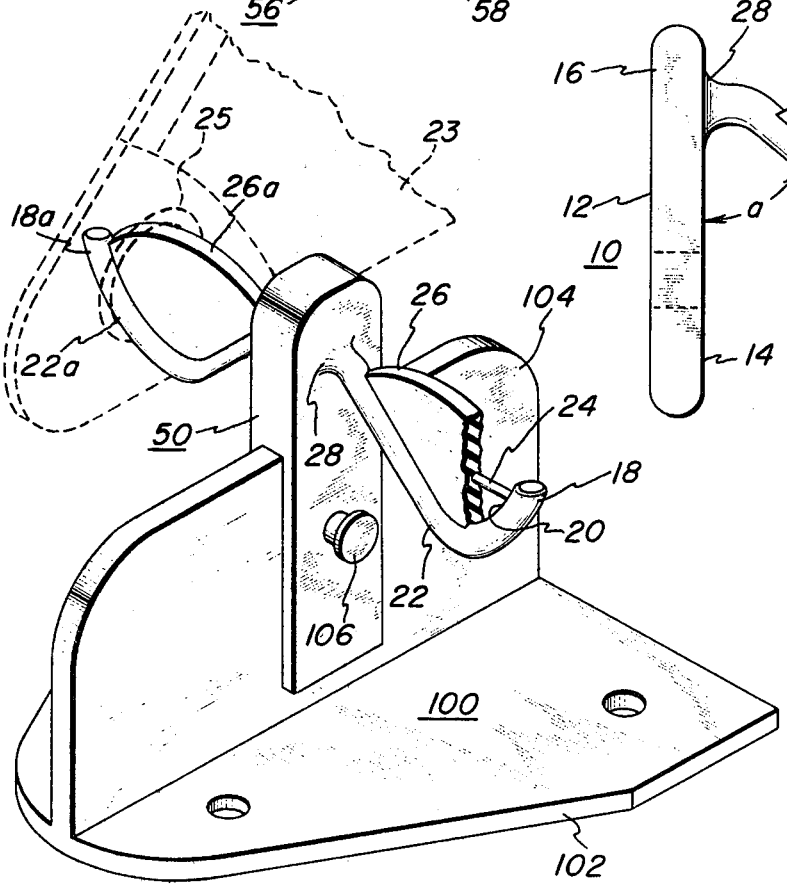
FIG. 6
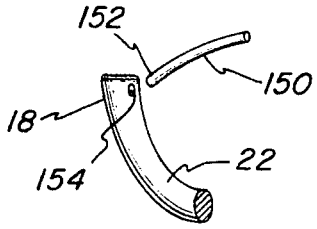
FIG. 5
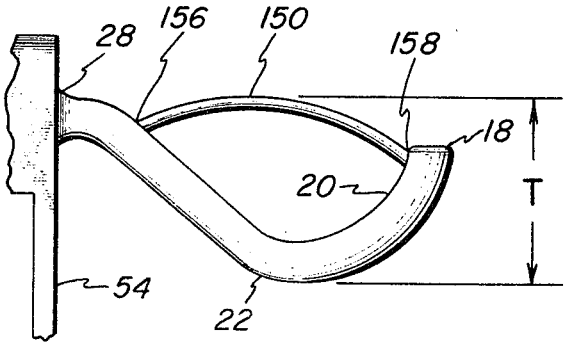

TACK HOOK ASSEMBLY FOR SAIL BOATS

BACKGROUND OF THE INVENTION

1. Field of the Invention

This invention relates generally to marine hardware and in particular to a tack hook assembly used in sailboats.

2. Description of the Prior Art

Prior art means for attaching the tack of a headsail or jibsail to the bow of a sailboat are "D" shackles, snap shackles, and tack hooks. A "D" shackle is difficult to use when the boat is under way because the pin of the "D" shackle must be aligned with the aperture of the stem fitting after inserting the "D" shackle through the tack ring of the sail. This operation requires two hands and represents a safety hazard to the individual performing the task. Occasionally, the pin may be lost, rendering the "D" shackle inoperative until the pin is replaced.

A snap shackle is somewhat easier to use because it can be permanently attached to the stem fitting of the boat. The snap shackle is more expensive than a "D" shackle and also requires the use of both hands. The easiest fitting to employ for this purpose is a tack hook. However, this device does not have a means for positively retaining the sail attached to the stem fitting, and when there is no tension on the halyard, the sail can fall off the hook. To avoid this problem, usually shock cords and the like have been used to hold the sail on the hooks. Again, this requires both hands to attach and release the headsail.

It is therefore an object of this invention to provide a new and improved tack hook assembly for sailboats which overcomes the deficiencies of prior art devices.

Another object of this invention is to provide a new and improved tack hook assembly which enables a headsail to be retained thereon until forcibly removed by lateral movement.

A further object of this invention is to provide a tack hook assembly for attaching two headsails thereto at the same time, and for the attaching or releasing of each sail with only one hand while the boat is under way.

Other objects of this invention will, in part, be obvious and will, in part, appear hereinafter.

BRIEF DESCRIPTION OF THE INVENTION

In accordance with the teachings of this invention there is provided a tack hook assembly for a sailboat comprising an upright support member having two opposed ends. One end has mounting means for attaching the member to the bow of a sailboat. The other end has at least one lateral member attached thereto and extending outwardly therefrom. The lateral member has a first curved portion wherein the outer surface thereof extends generally in a downwardly direction. A resilient member spans the area defined by the inner surface and is attached at least at each opposed end thereof to the inner surface of the lateral member. The resilient member also has a second curved portion. The outer surface of the second curved portion projects in a generally upward direction and opposite to the direction of that of the first curved portion of the lateral member. The total distance between the apex of the second curved portion of the resilient member and the apex of the first curved portion of the lateral member is greater than the diameter of the eye at the tack of the jib. The jibsail is attached by pushing the eye over the combination of resilient and lateral members. The slope of the outer surface of the first curved portion of the lateral member nearest the upright support member causes the eye at the tack which is under tension to move toward the apex of an angle defined by the outer surface and the upright support member.

The resilient member may be made of a spring tempered metal or a rubber, synthetic rubber, pliable epoxy or a polymer material. A highly preferred material is a room temperature vulcanizing silicone rubber. A lateral support member may be incorporated in the resilient material when the material is non-metallic.

Stainless steel, preferably a welding type such as 316 Type stainless steel, may be employed for its corrosive resistance, particularly to fresh and salt water environments.

Preferably, two lateral members are attached to the upright support member, each of which has a resilient member affixed thereto.

DESCRIPTION OF THE DRAWINGS

FIG. 1 is a front elevation view, partly in cross-section, of a tack hook assembly embodying the present invention as employed to attach the tack of a sail to the bow of the boat.

FIG. 2 is a cross-sectional view of a portion of the assembly of FIG. 1, taken along cutting plane 2—2.

FIG. 3 is a front elevation view, partly in cross-section, of another embodiment of a tack hook assembly.

FIG. 4 is an isometric view, partly in cross-section, of the tack hook assembly of FIG. 3 mounted on a stem fitting assembly.

FIG. 5 is a front elevation view of a portion of another embodiment of a tack hook assembly.

FIG. 6 is a view of the mating arrangement of two members of the tack hook assembly of FIG. 5.

DESCRIPTION OF THE INVENTION

Referring now to FIGS. 1 and 2, there is shown a tack hook assembly 10 comprising a support member 12 having two opposed ends 14 and 16. Means are provided at end 14 for mounting the assembly 10 to the bow or a fixture of a boat. A lateral member 18 is attached to, and extends horizontally outward from end 16 of the member 12. The lateral member 18 has a curve-shaped configuration. Surfaces 20 and 22 define the respective inner and outer surfaces of the concave portion of member 18. A lateral support member 24 extends across the interior of the concave portion of member 18 and is affixed at its respective opposed ends to surface 20.

A resilient member 26 is disposed within the concave portion of member 18, molded about the lateral support member 24, and affixed at least to the surface 20. The thickness of the resilient member 26 is such that the total thickness "t" is greater than the diameter of the cleat, shackle, hook or other fastener device which is to be attached to, and retained by, the tack hook assembly 10. The resilient member 26 has sufficient resiliency, however, to permit the fastener device to be readily forced over the combination of members 18, 24 and 26 by use of only one hand of a person adjusting the forward sails 23 of a boat. In a like manner, the member 26 has sufficient rigidity to prevent the fastener device from accidentally becoming disengaged from the tack hook assembly 10 where tension is relieved on the line or sail including the fastener device thereon. The member 24 provides support for the member 26 and to prevent its accidental separation from member 18.

The tack hook assembly 10 is preferably designed to provide a positive engagement of the fastener device when tension is applied thereto. The slope of surface 22 of member 18 in the vicinity of the joining of end 28 to the support member 12 is selected to force the eye 25 of the tack device upward to the apex of the angle $\alpha$, its strongest point, when tension is applied to the fastener device.

The materials for making the components of the tack hook assembly 10 must have suitable corrosive protection for the working ambient, i.e., fresh or salt water environment, to which the assembly 10 is exposed. The materials must also be compatible to each other and be capable of ease of manufacture and assembly to produce a reliable functioning assembly 10. Each of the members 12, 18 and 24 is preferably made of stainless steel as illustrated, for example, Type 316 stainless steel, which is preferred because of its good welding characteristics. This material selection provides the necessary corrosion resistance, manufacturing capability, functional reliability and aesthetic value. Although other methods of manufacture may be practiced, the members 12, 18 and 24 are preferably joined together by welding.

The resilient member 26 may be comprised of rubber, epoxy, polymer materials and the like. A room temperature vulcanizing silicone rubber is a particularly suitable material for making member 26.

With reference now to FIGS. 3 and 4, there is shown an alternate embodiment of the invention, a tack hook assembly 50 for use in sailboat racing where it is desirable to change headsails during the race. The first headsail is usually not removed until a replacement has been put in place. It is also important that a fastener device of each sail 23 be retained by the tack hook assembly 50 until removed manually. All reference numerals which are the same as denoted in FIGS. 1 and 2 denote the same items thereof which function in the same manner as previously described.

In this embodiment the tack hook assembly 50 has two lateral members 18 and 18*a*, attached to end 52 of support member 54. This preferred configuration embodies an integral fork member 56, at end 58 of assembly 50, which provides a means for mounting the assembly 50 to a stem fitting assembly 100. Walls 60*a* and 60*b* define apertures extending entirely through respective legs, or tynes, 62*a* and 62*b* of member 56 which are aligned with each other and provide a means for mounting assembly 50. Surface 54 of end 58 between the legs, or tynes, 62*a* and 62*b*, is preferably flat to retain assembly 50 in an upright position when attached to stem plate fitting assembly 100 of a sailboat.

Stem plate fitting assembly 100 comprises mounting plate 102 for mounting assembly 100 to the bow of the sailboat. Upright member 104 provides a means for mounting tack hook assembly 50 to fitting assembly 100. The thickness of member 104 is less than the width between legs, or tynes, 62*a* and 62*b* of member 56. An aperture (not shown) extends through the thickness of member 104 and when aligned with the apertures of legs 62*a* and 62*b* enable a fastener device 106 to affix and retain assembly 50 to member 104. The location of the aperture in member 104 is such that the flat surface 64 retains assembly 50 in a fixed upright position.

The configuration of assembly 50 enables one to replace two shackles or hooks now used in setting headsails of a sailboat. It also enables a person to perform the necessary functions of attaching and removing fastener devices with only one hand, thereby increasing the personal safety to the individual. The headsail 23 cannot become accidentally unfastened when tension is removed, thereby preventing undesirable incidents when the sailboat is underway. The integral fork member 56 and flat surface 64 enables one to employ a pin with a safety ring for the fastening device 106 to attach tack hook assembly 50 to stem plate assembly 100 in place of a nut and bolt which is usually employed.

Referring now to FIGS. 5 and 6, there is shown another embodiment of the invention wherein a resilient spring member 150 replaces support member 24 and resilient member 26. The member 150 has an integral tongue member 152 at each end thereof. Member 150 is shaped to fit in slot or groove 154 provided in two spaced places 156 and 158 of surface 20 to receive and retain tongues 152. The length of member 150 is such that when assembled to member 18 it has a convex configuration. The total maximum distance "T" from surface 160 to surface 22 is greater than the diameter of the eye 25 of the fastener device which is to be attached to either assembly 10 or 50, of which this embodiment may be a part thereof. This embodiment functions in the same manner as previously described combination of members 18, 24 and 26.

A tack hook assembly of the configuration shown in FIGS. 3 and 4 was constructed of 316 Type stainless steel. The members 24 and 24*a* were welded to respective members 18 and 18*a*. Each member 18 and 18*a* was welded to the respective surface of end 52 of member 54. Heliarc welding method was practiced to effect the weld joints. The resilient member was formed from a room temperature vulcanizing silicone rubber procured from General Electric Company, and sold commercially under their catalog number RTV-77.

The completed assembly was attached to a stem fitting assembly 100, shown in FIG. 3, which was mounted to the deck of the bow of the sailboat. The tack hook assembly 50 enabled one person to engage and disengage fastener devices when changing headsails while underway with the use of only one hand. The safety to the individual performing this task was not jeopardized and therefore individual safety was enhanced by the assembly 50. All fastener devices remained positively engaged until disengaged by hand. When each of the headsails was hoisted in place, the configuration of lateral members 18 and 18*a* forced the respective fastener device upwardly to the respective apex of angle $\alpha$ each time.

The invention is further illustrated by the following example which describes making the tack hook as shown in FIG. 3 designed to accommodate two sails. The curved lateral members 18 and 18*a* were formed from 5/16" stainless steel rods which were heliarc welded to the support member 54 such that each rod extends out about 3" from said support member 54. Narrow reinforcing rods 24 and 24*a* are attached by welding across the curved portions of lateral members 18 and 18*a* respectively.

The resilient member 26 is now formed and molded in place as shown in FIG. 3. Initially, to provide good adhesion the stainless steel portions where the silicone is to be applied are treated with a primer such as Silicone Primer SS 4004, obtained from General Electric. This can be done by dipping or by using an applicator. The primer was permitted to dry for about one hour.

Then the silicone rubber was prepared for molding by mixing RTV 77 silicone rubber compound (General Electric) with a sufficient amount of RTV silicone rubber curing catalyst (dibutyltin dilaurate) in proportion of about 35 drops curing agent to 100 grams of silicone compound. The amount of work time was about one hour.

The silicone rubber mixture was applied to the assembly by placing a mold of the desired shape around the lateral supports. The mold was then filled by injecting the mixture into the mold. This procedure resulted in only few air bubbles being formed. The curing time is typically about 18 to 24 hours.

It will be appreciated that the invention is not limited to the specific details shown in the illustrations and that various modifications may be made within the ordinary skill in the art without departing from the spirit and scope of the invention.

What is claimed as new and desired to be secured by Letters Patent of the United States is:

1. A tack hook assembly for attaching a sail to the bow of a sailboat, wherein the tack hook is mounted on the sailboat and an eye hole is located at the tack of the sail, said assembly comprising:

an upright support member having two opposed ends, the first end having mounting means for affixing said member to the bow of the sailboat;

a rigid lateral member attached to the second end of said upright support member and extending outwardly therefrom, said lateral member having a first substantially convex-shaped section wherein the curved outer section thereof extends generally in a downward direction;

a resilient member spanning a space defined by the curved inner section of the first convex-shaped portion and extending to a point near the lateral member, said resilient member having a second substantially convex-shaped portion wherein the curved outer section thereof extends generally in an upward direction, such that the combination of said first convex-shaped portion and said second convex-shaped portion provide a substantially biconvex configuration, and the total distance between the apexes of the two convex-shaped portions is greater than the diameter of said eye hole.

2. The tack hook assembly of claim 1, wherein said mounting means is an integral fork-shaped member having at least two legs, each leg having a lateral aperture extending therethrough and aligned with the aperture of the adjacent leg.

3. The tack hook assembly of claim 2, wherein two lateral members are attached to the second end of said upright support member and extend in opposite directions therefrom.

4. The tack hook assembly of claim 3, wherein the curved outer section of said lateral member is adapted to urge said eye hole, after being inserted under tension on said lateral member, to seek a position near the vertex of an angle defined by said curved outer section and said upright support member.

5. The tack hook assembly of claim 4, further including a support member laterally spanning the inner portion of the lateral member and attached thereto, and the resilient member comprising a moldable material disposed in said space.

6. The tack hook assembly of claim 5, wherein said upright support member, said rigid lateral member and said support member are made of metal.

7. The tack hook assembly of claim 6, wherein said metal is stainless steel.

8. The tack hook assembly of claim 7, wherein said moldable material is a member selected from the group consisting of rubber and polymeric resin.

9. The tack hook assembly of claim 8, wherein said moldable material is a room temperature vulcanizing silicone rubber.

10. The tack hook assembly of claim 3, wherein said resilient member is made of metal.

11. The tack hook assembly of claim 10, wherein said metal in stainless steel.

* * * * *